US007735806B2

(12) United States Patent
Prater et al.

(10) Patent No.: US 7,735,806 B2
(45) Date of Patent: Jun. 15, 2010

(54) PANEL REMOVAL TOOL AND METHOD

(75) Inventors: Jeremy Carl Prater, Oxnard, CA (US); Kevin Michael Trejo, Camarillo, CA (US)

(73) Assignee: Scosche Industries, Inc., Oxnard, CA (US)

( * ) Notice: Subject to any disclaimer, the term of this patent is extended or adjusted under 35 U.S.C. 154(b) by 53 days.

(21) Appl. No.: 11/766,603

(22) Filed: Jun. 21, 2007

(65) Prior Publication Data

US 2008/0315165 A1 Dec. 25, 2008

(51) Int. Cl.
*B25B 27/00* (2006.01)
*B66F 15/00* (2006.01)

(52) U.S. Cl. ..... 254/25; 254/28; 29/270

(58) Field of Classification Search ..... 254/25, 254/28, 131, 21; 29/243.56, 270
See application file for complete search history.

(56) References Cited

U.S. PATENT DOCUMENTS 106,015 A * 8/1870 Wood
542,989 A * 7/1895 Books
549,895 A * 11/1895 Brown ..... 254/25
1,486,820 A * 3/1924 Wilder
2,863,632 A * 12/1958 Faundrich
D197,205 S * 12/1963 Estwing
4,205,823 A * 6/1980 Goldy ..... 254/28
4,553,737 A * 11/1985 Yi ..... 254/28
4,844,416 A * 7/1989 Hand
5,207,126 A * 5/1993 Schaben ..... 81/45
5,695,172 A * 12/1997 Hreha
5,781,956 A * 7/1998 Kelsay et al. ..... 15/143.1
5,957,429 A * 9/1999 Khachatoorian
6,257,553 B1 * 7/2001 Khachatoorian
6,409,152 B1 * 6/2002 Bagley ..... 254/18
6,786,472 B1 * 9/2004 Dahl
6,893,004 B2 * 5/2005 Ploeger
2004/0026674 A1 * 2/2004 Hernandez et al.
2005/0173685 A1 * 8/2005 Skach

* cited by examiner

*Primary Examiner*—Lee D Wilson
(74) *Attorney, Agent, or Firm*—Arent Fox LLP

(57) ABSTRACT

A panel removal tool includes a plastic handle, a forked portion at a first end of said plastic handle, wherein said forked portion further comprises a fulcrum, and a blade portion at a second end of said plastic handle, said second end being opposite said first end.

4 Claims, 3 Drawing Sheets

PANEL REMOVAL TOOL AND METHOD

BACKGROUND

1. Field

The present disclosure relates generally to hand tools, and more particularly, to the operation and use of a hand tool configured to remove interior vehicle panels.

2. Background

The art of removing interior vehicle panels has been mostly subject to brute force removal or tools that are not particularly useful beyond their restricted use to a particular make or model vehicle. Indeed, the absence of a panel removal tool that minimizes damage to fragile and delicate vehicle interiors has been prevalent in the industry. At present, one of ordinary skill in the art must either attempt to remove a vehicle's panel by using a tool that serves a different purpose, e.g., a flat-head screwdriver, a metal pry tool, etc., all of which are unsuitable for the efficient and safe removal of panels.

The use of these unsuitable tools creates a problem wherein the person of ordinary skill may inadvertently and accidentally damage a vehicle's interior panel and/or may render the clips not reusable. In addition, the unsuitable tools may not always be suitable for use in troublesome areas that are not large enough for the use of anything other than a small, compact, easily manipulated hand tool. Thus, there is a need for a small tool that will not damage a vehicle's panels or clips.

SUMMARY

One aspect of a panel removal tool is disclosed. A panel removal tool includes a plastic handle, a forked portion at a first end of said plastic handle, wherein said forked portion further comprises a fulcrum, and a blade portion at a second end of said plastic handle, said second end being opposite said first end.

Another aspect of a panel removal tool is disclosed. A panel removal tool includes a plastic handle, a two-pronged portion at a first end of said plastic handle, wherein said two-pronged portion further comprises a clip engaging element, and a first blade portion at a second end of said plastic handle, said second end being opposite said first end.

One aspect of a method of removing car trim and panels is also disclosed. The method includes acquiring a panel removal tool, wherein said panel removal tool comprises a plastic handle; a forked portion at a first end of said plastic handle, wherein said forked portion further comprises a fulcrum; and a blade portion at a second end of said plastic handle, said second end being opposite said first end, inserting said forked portion of said panel removal tool between a vehicle's panel and a vehicle's supporting structure, and applying downward force on said blade portion end of said panel removal tool so as to remove a clip holding said vehicle's panel onto said vehicle's supporting structure.

Another aspect of a method of removing car trim and panels is also disclosed. The method includes acquiring a panel removal tool, wherein said panel removal tool comprises: a plastic handle; a forked portion at a first end of said plastic handle, wherein said forked portion further comprises a fulcrum; and a blade portion at a second end of said plastic handle, said second end being opposite said first end; inserting said blade portion of said panel removal tool between a vehicle's panel and a vehicle's supporting structure; and applying twisting motion on said plastic handle so as to remove a clip holding said vehicle's panel onto said vehicle's supporting structure.

These, as well as other objects, features and benefits will now become clear from a review of the following detailed description of illustrative embodiments and the accompanying drawings.

BRIEF DESCRIPTION OF DRAWINGS

Aspects of the present invention are illustrated by way of example, and not by way of limitation, in the accompanying drawings wherein.

DETAILED DESCRIPTION

The detailed description set forth below in connection with the appended drawings are intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details.

Figure 1:
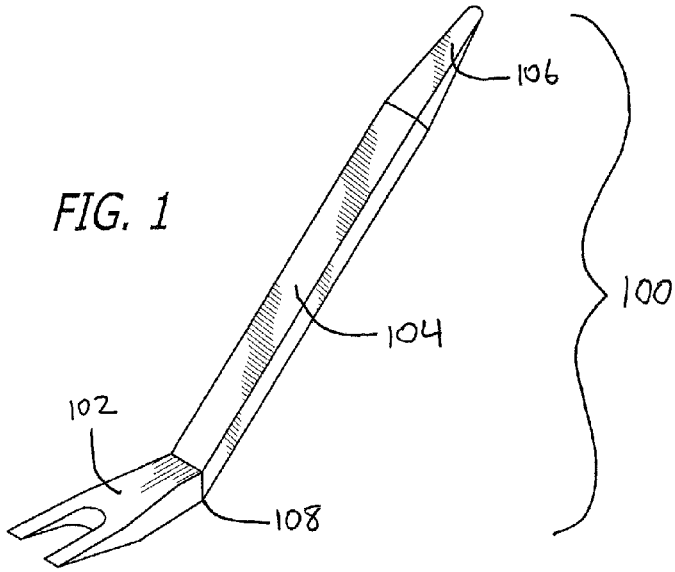
FIG. 1 is a perspective view of a panel removal tool.

FIG. 1 is a perspective view of a panel removal tool. The panel removal tool 100 includes a forked portion 102 and a blade portion 106 at the opposite end of a handle 104. So that the panel removal tool 100 does not damage, scratch or otherwise mar a panel, the panel removal tool may be manufactured from a plastic or other polyurethane material. The gentle characteristics of plastic, as opposed to any metal, may allow one of ordinary skill in the art to use the panel removal tool 100 without fear of irreversibly tainting a vehicle's fragile interior. Also, it may be appropriate, and indeed beneficial, to manufacture the panel removal tool 100 from one single mold so as to create one component that provides various functions.

The panel removal tool 100 may have two ends; both having utility in the effective removal of panels. The forked portion 102 may be used to remove large clips 502 that have traditionally been used to hold large panels or dashboards to the underlying structural support material. (See FIGS. 5-6). The blade portion 106 may be used to remove small retaining clips that have traditionally been used to hold small interior portions to the underlying larger panel or, in some cases, the structural support material.

The forked portion 102 joins the handle 104 at a junction 108. The junction 108 acts as a fulcrum or pivot point so that when a downward force is applied to handle 104 or the blade portion 106, the forked portion 102 is forced in an upward direction. The upward motion of the forked portion 102 provides the force that is applied to an engaged large clip 502 so as to disengage and remove a panel.

Figure 2:
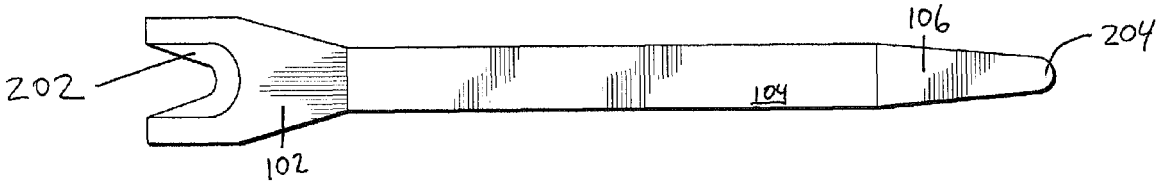
FIG. 2 is a top elevational view of a panel removal tool.
Figure 5:
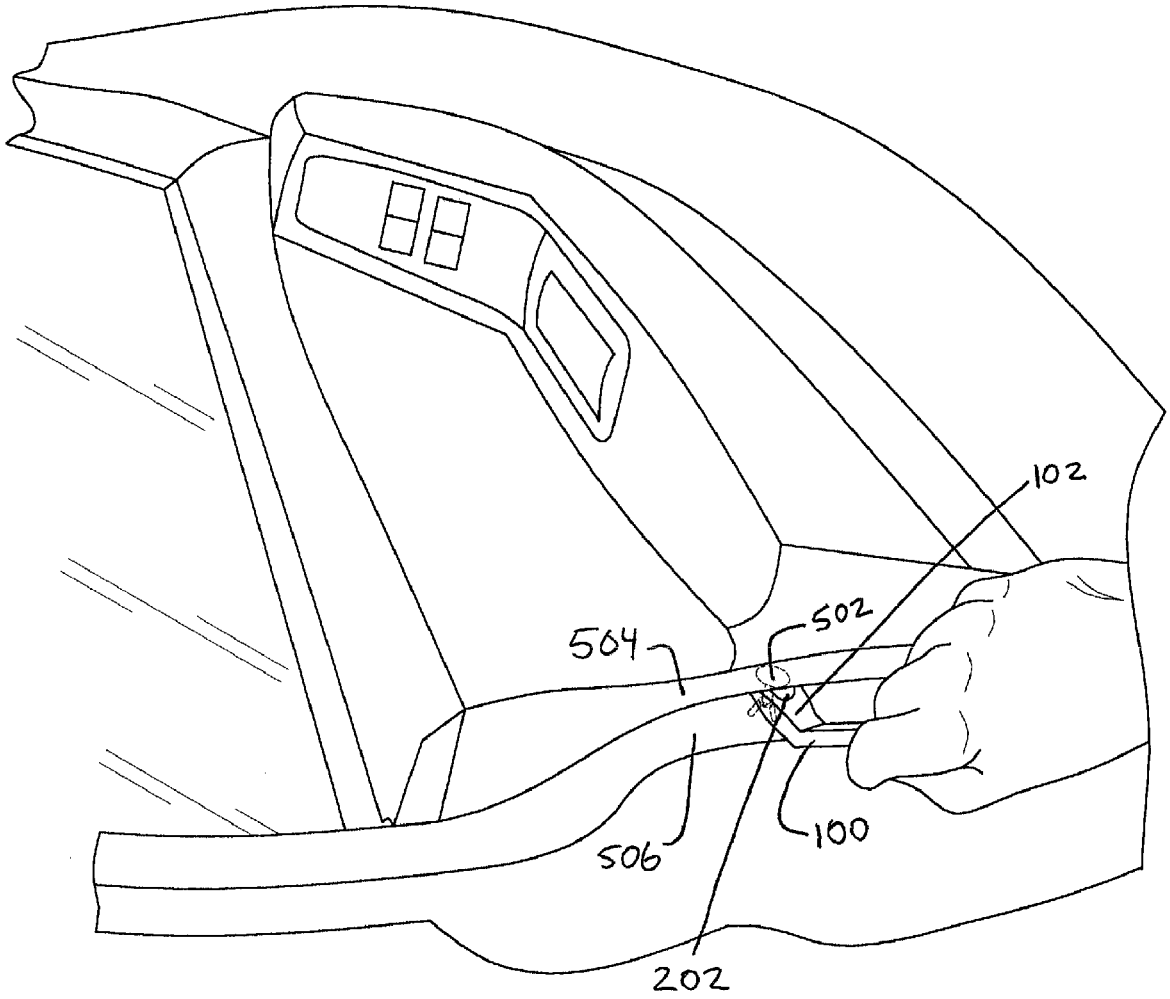
FIG. 5 illustrates the conventional use of a panel removal tool when used to pry a vehicle's panel.
Figure 6:
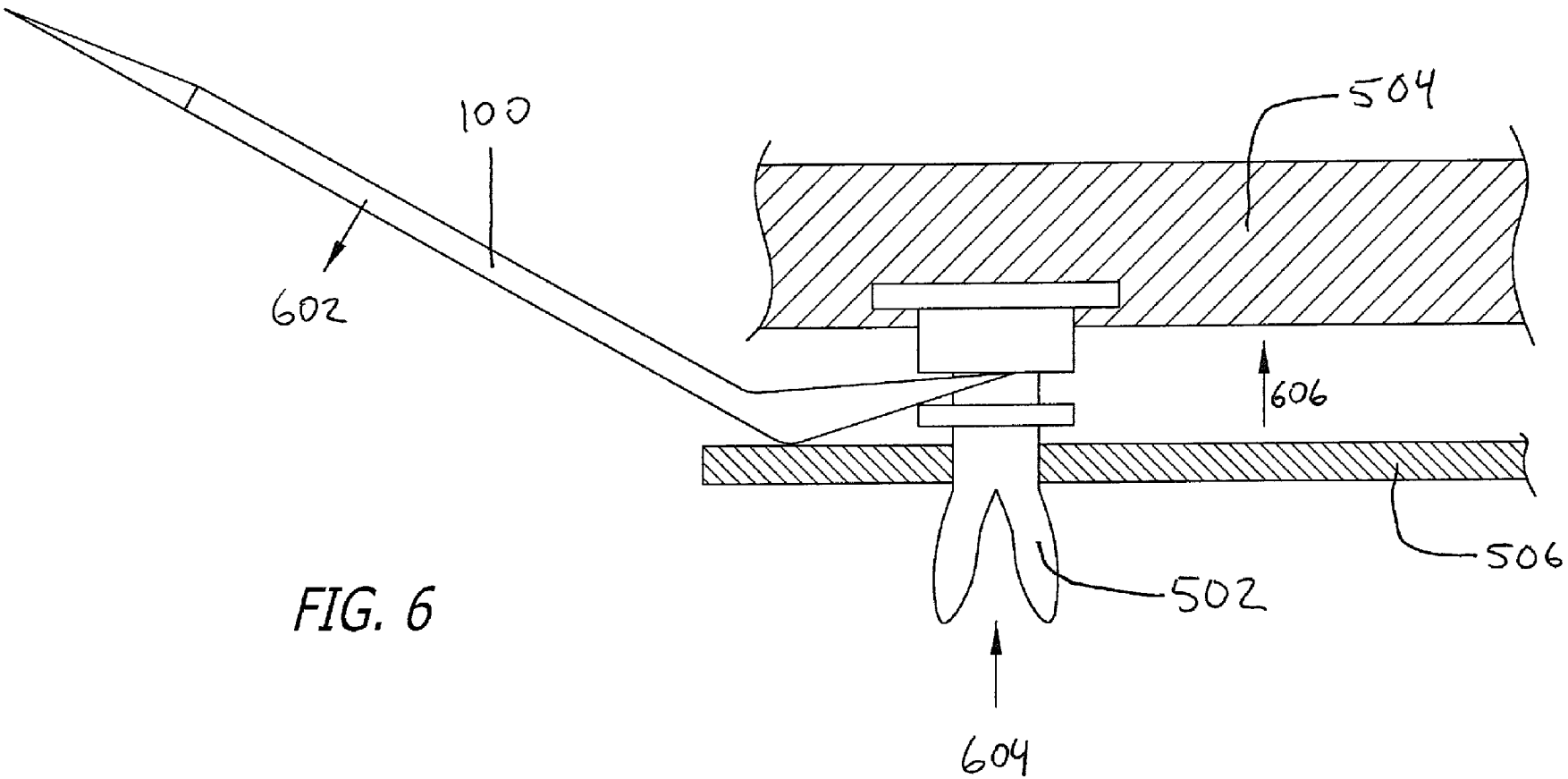
FIG. 6 is a side elevational view of a panel removal tool, showing the directions of the prying force as well as the force applied by the hand of the user.

FIG. 2 is a top elevational view of a panel removal tool. The panel removal tool 100 may have a clip receiving portion 202 at the forked portion 102. Referring to FIGS. 2, 5 and 6, the clip receiving portion 202 has an internal blade edge so as to engage a large clip 502 that a user may wish to remove. Thus, the clip receiving portion 202 does more than merely receive the clip 502 but further engages the clip 502 by raising and drawing in the clip 502 fully into the clip receiving portion 202. Once the clip 502 is fully engaged in the clip receiving portion 202 of the panel removal tool 100, a downward force may be applied to the handle 104 or blade portion 106 in order to remove the clip 502.

Returning to FIG. 2, the panel removal tool 100 may also have a substantially flat round end 204 at the tip of the blade portion 106. The round end 204 may be used to remove small retaining clips that would be more difficult to access than with the forked portion 102. A user may insert the round end 204 in between a panel and underlying structure and twist the handle 104 so as to force the creation of a space between the panel and the underlying structure. Once a release threshold has been reached, the retaining clip will disengage and the user will be able to remove the panel.

Figure 3:
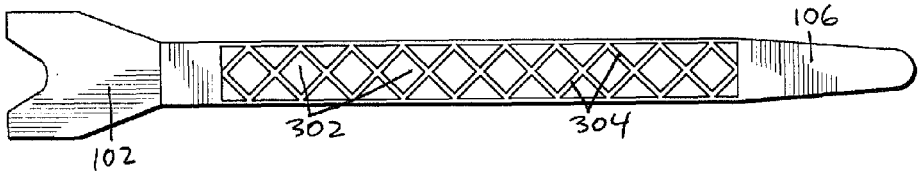
FIG. 3 is a bottom elevational view of a panel removal tool.

FIG. 3 is a bottom elevational view of a panel removal tool. In accordance with one aspect of the panel removal tool, a cavity 302, or a hollow portion, may be formed in the handle 104 by removing substantially all the manufacturing material from the underside of the handle 104. By removing the material (or likewise, by manufacturing with an underside cavity 302), the handle 104 will be more flexible, weigh less, and capable of being manipulated with ease. In at least one configuration of the handle 104, structural reinforcement walls 304 may be formed within the cavity 302 to increase its structural integrity. In this fashion, one may avail themselves of the benefits of having a cavity 302 on the underside of the handle 104 but still enjoy the stability and rigidness that a solid handle 104 may present.

Figure 4:
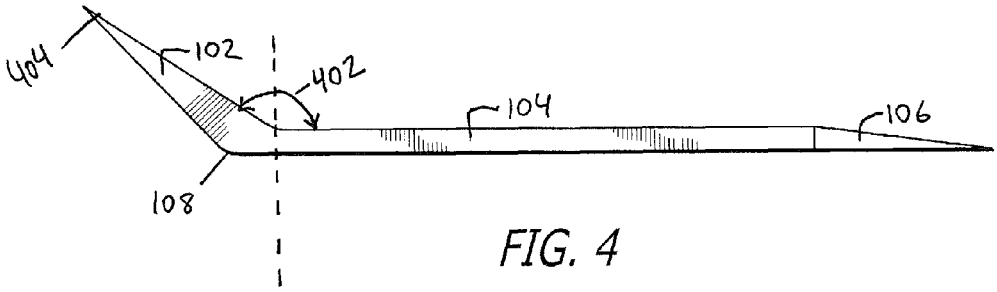
FIG. 4 is a side elevational view of a panel removal tool.

FIG. 4 is a side elevational view of a panel removal tool. This illustration shows the blade formations at the blade portion 106 and another blade portion 404 at the end of the forked portion 102. The blade portion 404 may assist the user in inserting the forked portion 102 in between a panel and underlying structure. The gradual widening of the forked portion 102, towards the junction 108, further allows the clip engaging portion 202 (See FIG. 2) to raise a large clip 502 (See FIGS. 5-6) as a user attempts to a panel. Generally, the angle 402 between the forked portion 102 and the handle 104 is selected to be anywhere between 95° and 175°. This range will vary depending on the space and use of the panel removal tool 100. Thus, although the illustration depicts an angle 402 of approximately 135°, one of ordinary skill in the art would appreciate that any angle 402 within the range above is appropriate so long as the junction 108 still has the ability to provide a fulcrum point.

FIG. 5 illustrates the conventional use of a panel removal tool when used to pry a vehicle's panel. As illustrated, a panel removal tool 100 may be inserted in between a vehicle's removable panel 504 and the underlying structural support 506. As the panel removal tool 100 is inserted, the removable panel 504 and the support 506 begin to separate due to the blade portion 404 and taper of the forked portion 102. Once the panel removal tool 100 is fully inserted, and the clip receiving portion 202 has engaged the clip 502, a user applies a downward force so as to separate the engaged clip 502 from the support 506. Once a threshold level of force is applied, the clip 502 disengages and the user is able to freely remove the clip 502 and the removable panel 504 away from the support 506.

FIG. 6 is a side elevational view of a panel removal tool, showing the directions of the prying force as well as the force applied by the hand of the user. As illustrated, a downward force 602 is manually applied to the panel removal tool 100. The downward force 602 is transferred about a fulcrum to apply an upward force 606 at the forked portion 102 end of the panel removal tool 100. Having previously engaged the clip 502, the upward force 606 forces the clip 502 up and out 606 from the support 506. At threshold, the clip 502 disengages and the user is able to freely remove the clip 502 and the removable panel 504 away from the support 506.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but is to be accorded the full scope consistent with the language of the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A panel removal tool, comprising:

a handle comprising a cavity and a plurality of structural fortification walls within the cavity;

a forked portion extending from a first end of the handle at an angle to form a fulcrum with the handle, the forked portion comprising a forked portion bottom surface and a forked portion top surface tapering to the forked portion bottom surface, the forked portion further comprising a clip receiving portion, the clip receiving portion having a bottom edge flush with said forked portion bottom surface and a top edge flush with said forked portion top surface, said clip receiving portion comprising a sloped wall extending substantially about an inside perimeter of said clip receiving portion between said bottom edge and said top edge, said bottom edge and said top edge each having a semicircular contour; and a blade portion at a second end of the handle opposite the first end, the blade portion comprising a blade portion bottom surface and a blade portion top surface tapering linearly to the blade portion bottom surface.

2. The panel removal tool of claim 1, wherein the blade portion further comprises a semicircular blade edge, a first blade portion side edge, and a second blade portion side edge, the first blade portion side edge and the second blade portion side edge tapering together to meet the semicircular blade edge.

3. The panel removal tool of claim 1, wherein the forked portion further comprises a first forked portion side edge and a second forked portion side edge, the first forked portion side edge and the second forked portion side edge having a first portion extending outwardly from the handle and a second portion extending parallel to the handle from the first portion.

4. The panel removal tool of claim 1, wherein said angle of said fulcrum is between 95 degrees and 175 degrees.

* * * * *